United States Patent [19]

Sheem

[11] Patent Number: 4,681,325

[45] Date of Patent: Jul. 21, 1987

[54] GAME TOY

[76] Inventor: Sang K. Sheem, 2616 Starling Ct., Pleasanton, Calif. 94566

[21] Appl. No.: 722,230

[22] Filed: Apr. 11, 1985

[51] Int. Cl.[4] ..... F41J 3/00

[52] U.S. Cl. ..... 273/345; 273/93 R; 273/94

[58] Field of Search ..... 273/344–347, 273/408, 409, 94, 93 R, 88

[56] References Cited

U.S. PATENT DOCUMENTS

| | | | |
|---|---|---|---|
| D. 200,418 | 2/1965 | Olson | 273/408 X |
| D. 271,890 | 12/1983 | Astwood, Sr. | 273/409 X |
| 1,527,480 | 2/1925 | Hooper | 273/408 X |
| 2,562,089 | 7/1951 | Fishlove | 273/345 |
| 3,894,736 | 7/1975 | Foley | 273/347 |
| 3,941,383 | 3/1976 | Clarke | 273/346 |
| 3,979,117 | 9/1976 | Worsham | 273/94 R X |

FOREIGN PATENT DOCUMENTS

| | | | |
|---|---|---|---|
| 706462 | 3/1954 | United Kingdom | 273/409 |
| 2116053 | 9/1983 | United Kingdom | 273/403 |

OTHER PUBLICATIONS

Super Star Sports Games; Playthings Magazine, 2-1977.

*Primary Examiner*—Paul E. Shapiro
*Attorney, Agent, or Firm*—Francis H. Lewis

[57] ABSTRACT

A dart game toy that is suitable for simulating the popular ball games comprises a dart, a group of offensive target pieces to be used by offensive team, and a group of defensive target pieces to be used by defensive team, wherein one game play consists of a set of sequential dart throwings being thrown alternately by offensive team and defensive team. The objective of the offensive team is to have the dart landed on the offensive target pieces, and the objective of the defensive team is to have the dart landed on the defensive target pieces that are recognized as defensive countermeasures against the offensive target pieces on which the dart have landed. Game rules are made in such a way that the outcome of the sequential dart throwings are interrelated and interlocked, making the result of the set of dart throwings determinable after and only after all the dart throwings belonging to the play have been completed. In the game, the ratio in sizes between each offensive target piece and the corresponding defensive target as well as the ratio among the targets of different play options reflect the level of difficulty of each play option.

17 Claims, 9 Drawing Figures

GAME TOY

BACKGROUND AND SUMMARY OF THE INVENTION

The present invention relates to a dart game.

In the present invention dart games are to be interpreted broadly in which objects, to be called darts, are launched in some fashion and manner into some direction, either in substantially horizontal, vertical or other angle, with an objective to have the objects or darts landed in specific areas or locations to be called targets or target pieces. Target may have varying shapes of either the flat, the protruded, or the recessed.

In general, the main objective of the conventional dart games is to measure and compare the skill of dart throwing. Even though the objective itself has a good and sound recreational value, the result is that the games are often too simple-minded and even boring in a sense that they do not require high level mental activities in terms of game planning, strategy setup, and most importantly needs for instant countermeasure reactions. In analogy, the conventional dart games may be compared to the activity of football throwings between two or three people standing relatively in fixed positions in a picnic area: they need football throwing skills to sustain the activity but it is surely a slow and idling activity; however, dart games formulated by the present invention as described herein may be compared to the real football game played in the real football field.

Another drawback of conventional dart agmes is that the level of difficulty in achieving an objective in a dart throwing is mostly determined by the relative size and location of one target area or piece being aimed at. In comparison, in real sports such as the football game as an example, difficulty in a passing game depends not only on the level of difficulty of passing a ball, for example over 30 yards, between the quarterback and a receiver, but also on the level of difficulty or easiness of defending the long-yardage passing game by the defensive team. The combination of the two factors is what really matters. In the conventional dart games this factor is totally or largely missing. In the present invention this factor may be easily implemented by adjusting the ratio in sizes between a target for an offensive dart throwing and the corresponding target for a defensive dart throwing.

Accordingly, the main objective of the present invention is to devise dart throwing games that require not only the dart throwing skill but also high level mental activities throughout the games, resulting game psychology as complex as that to be found in the conventional ball games such as the football and the baseball. This objective is obtained in the present invention first by providing two seperate groups of targets, one group to be used by one team and the other group to be used by the opposing team; secondly requiring that a play consists of a plurality number of dart throwings alternated between the two teams; then lastly interrelating and interlocking one dart throwing by one team to the subsequent dart throwing by the other team in determining the result of the set of alternate dart throwings: these provisions give the players chances to respond and counteract each other.

In the most of conventional dart games, a dart throw by one player is not interlocked to, influenced by, and depending on the subsequent dart throw by the opposing player in determining the score or result of each dart throw. This factor makes the games slow and less exciting. In the present invention this almost fatal drawback is remedied. After all, most of the excitement of, for example, the football game stems from the reactive nature of two teams battling in the field. Without the reactive responses in the forms of countermeasures, effort to guess forthcoming response, risk-taking play option, and last moment play decisions, the football game would be as exciting as the monotonous ball throwings in a picnic area.

Another added feature of the present invention is that the ratios in sizes between offensive targets and corresponding defensive targets may be adjusted to vary the level of difficulty or easiness of various play options. Accordingly, players should consider not only the easiness or difficulty of his hitting a target area or piece with the dart, but also easiness or difficulty of the opponent player's hitting the corresponding target area or piece within each pair of the interlocked sequential dart throwings.

Another objective of the present invention is to simulate the popular ball games such as the football, the baseball and the basketball into dart games so that people can enjoy in thier own houses the excitment of game planning and strategy formulation of the ball games by playing the invented dart games.

Another objective of the present invention is to provide opportunities to the people to learn, study and appreciate the various game rules, strategies, and play options through playing the simulated ball games embodied after the present invention.

The details of the features and advantages of the present invention will be further clarified in the following description and drawings.

DETAILED DESCRIPTION

Figure 1:
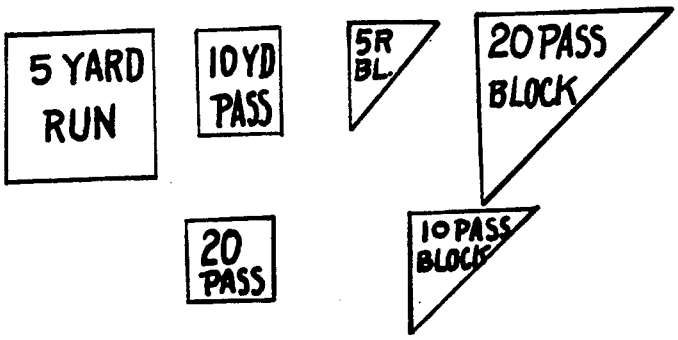
FIG. 1 shows in a schematic form two groups of target pieces.

The present invention comprises basically a dart, and two groups of target pieces, one group consisting of "offensive targets" and the other group consisting of "defensive targets". The relation between the two groups of targes is of mutual countermeasures. The players are accordingly divided into two teams and the two teams take turns and throw the dart. One team is on offensive and the other on defensive at a given moment. Each team may consist of only one player, and each of the target groups consists of one or more target pieces. The game consists of a series of plays, and each play consists of a set of two or more sequential dart throws, being thrown alternatetly between the opposing teams, that is, the first dart throw by one of the two teams followed by a throw by the other team, so on, within the set of dart throws.

Let's assume that, as an illustrative example, the offensive team is to throw first in each play, and further assume that a play consists of two dart throws. Then in its firt dart throw, the offensive team has an opportunity to ATTEMPT to achieve an offensive play, then in the subsequent throw the defensive team gets an opportunity to BLOCK OR COUNTERATTACK the offensive attempt. At the end of the two dart throws as specified, it is declaired that the objective of the offensive team is achieved if and only if a successful offensive attempt is followed by an unsuccessful defensive countermeasure. In all other possible combination of the events, the objective of the offensive team is considered to have failed. The INTERACTIVE or INTERLOCKING nature makes the present invention quite stimulating, as will become clearer below.

Let's assume that, as another illustrative example, the defensive team, instead of the offensive team, is the first to throw in each play. Then in its first throw, the defensive team has an opportunity to LIMIT the options for the subsequent offensive plays. Then in the subsequent throw the offensive team tries its best within the limitation imposed by the first dart throw by the defensive team.

In the both examples, regardless of which team throws the dart first within a set of dart throwings for a play, the basic features of the invention are first the existance of two seperate groups of target pieces for each of the opposing teams, respectively, and secondly the interactive nature of dart throwings within a play, making the game literally a game, in which within a set of dart throwings for a play, the outcome of one dart throw does influence, limit, or countermeasure the other dart throw, or vice versa.

It is possible to have more than two groups of target pieces as a simple extension of the current arrangement: however, we will describe the present invention with the case of two groups for the sake of the simplicity of discussion, with an understanding that it is possible to make a simple and obvious extension to cases with more than two groups of targets without changing the basic features of the present invention.

Various dart games can be created by adopting the basic game feature of the INTERLOCK BETWEEN TWO GROUPS OF TARGETS. A simulated football game will be first described to illustrate the way how the basic feature of the present invention is embodided and works. FIG. 1 shows in a schematic fashion two groups of target pieces. The target pieces of the offensive group contain identification or insignia on the target surfaces that specify or symbolize various offensive play options of the football game. For example, the play options may include "2.5 yard run attempt", "5 yard run attempt", "10 yard pass attempt", "20 yard pass attempt", etc. We will call the pieces belonging to the offensive group "offensive targets". In actual embodiment, the words marked on the offensive targets may be abbreviated or even encoded for the sake of simplicity: for example, "5 yard run attempt" may be shortened to "5 yard run" or 5 run", or even "5 R". Such abbreviation will be especially necessary when the target pieces are too small to hold the whole words. In any event, an offensive dart throw, when successfully done, is understood to be mere an attempt, not a success by itself yet in achieving the offensive objective, regardless of whether the words on the target pieces contain the word "attempt" or do not contain the word explicitly as a result of the abbreviation; that is, the offensive team gains the yardage only when the defensive team fails to block or counterattack the attempt in the subsequent defensive play. This will be further elaborated in the following paragraph. This point is the key ingredient of the present invention, and can be stated in a general term that the outcome of the dart throwings become determinable after and only after all the dart throwings belonging to the set are completed.

Accordingly, in continuing the description of the simulated football game, a play is not over until the opposing team (defensive team in this particular case) has an chance to respond. In FIG. 1 are thus shown the defensive group of target pieces. The target pieces contain various defensive countermeasures such as "2.5 yard run attempt block", "5 yard run attempt block", "10 yard pass attempt block", "20 yard pass attempt block", and also some counterattacks such as "Fumble induced by the defense" and "Pass interception". We will call this second group of the target pieces "the defensive targets". In actual embodiment, the descriptions for the defensive plays may be abbreviated or even encoded: e.g., "5 yard run attempt block" may be shortened to "5 run block" or"5 R block". If the two groups of the targets can be differenciated visually by color coding or other means such as the target shape, the target pieces may not even need words "block":"5 R" on a defensive target (piece) will means "5 yard run attempt BLOCK". Also, the fumble may be noted by a letter "F", and the interception by a letter "I". Note that, in FIG. 1, the offensive targets have square shape while the defensive targets have triangular shape.

In the present invention the size and location of each target may be cordinated with the size and location of the target of corresponding countermeasure. As an example, there may be two offensive targets for "5 yard run attempt" of substantially different sizes, size A for the larger one and size B for the smaller. Then the defensive target corresponding to the size A target is made larger than the defensive target corresponding to the size B target. Here exists the complication: there are two options for the five yard run attempt, the easier one and the harder one. The offensive player knows that the easier (larger) offensive target for him is paired with the easier (larger) defensive target for the opponent. He will choose one by evaluating not only the confidence level of his own skill but also presumed level of opponent's skill, and probably also other considerations that may or may not be truly valid.

Stimulating complexity exists in general even in comparing the easiness or difficulties of different play options, between 5 yard run attempt and 10 yard pass attempt as an example: players should consider not only the sizes of his targets but also relative sizes of the opponents targets. The offensive targets for the 5 yards and that of 10 yards may be different by some factor, but the corresponding defensive targets may be different by some other factor, too. One should evaluate a combined ratio in his mind before he can determine which one he wants to go after at a particular situation, either being the first down or the third, and with a given presumed skill level of the opponent. Thus one can define the "effective target size" for each play option incorporating not only the ratio between targets but also the relative skill levels of the opposing players.

Further continuing the example with the football game, in general the immediate objective of the offensive plays is to get the first down. Thus, the offensive team takes the first turn and throws the dart. Let's assume the offensive team has landed the dart successfully on the "5 yard run attempt" target piece. Then the defensive team takes the subsequent turn and throws the dart. One choice for the defensive team in this situation is to hit the target "5 yard run attempt block". If the dart has landed on the target, the "5 yard run attempt" by the offensive is considered to have been blocked, and the game goes into the second down with still ten yards to go. The defensive team may decide alternatively to be more opportunistic and aim for the target "Fumble induced by defense". If the defensive team has succeeded in landing the dart on the "Fumble" target, it gets the ball back and become the offensive team.

If the offensive team fails in an attempt to hit any of the offensive targets, the defensive team may still take a turn. In this case, the defensive team concentrates only on the counterattack options such as "Fumble induced by defense" or "Interception".

It would be acceptable, even though not preferable, in embodiments of the present invention to share some, but not all, of the target pieces between the offensive and the defensive plays for simplicity: for example, there may be only one target piece with the words "5 yard run". When the offensive team hits the target, it is interpreted as "5 yard run attempt". Then one choice of the defensive team in the subsequent dart throwing is to hit the same target piece. If the defensive team hits the target piece, it is interpreted as "5 yard run attempt blocked". This applies only when it is clearly understood that a particular target piece is being shared between the offensive and the defensive plays. Otherwise, in general the offensive team and the defensive team have the seperate groups of targets.

The size of the target pieces may vary substantially from one to another. Actually it is preferable to make the size inversely proportional to the level of difficulty of a particular play option. For example, in the defensive play described in the example above, "Fumble induced by the defense" should be much more difficult to achieve compared to "5 yard run attempt block" in the real foodball game. Thus in the embodiment under the study, the target for the "Fumble induced by defense" may be made much smaller than the target for the "5 yard run attempt block". Actually in FIG. 1 the targets are shown to have varying sizes roughly following this guideline.

As described earlier the ratio in sizes between a target and its corresponding countermeasure target may be adjusted in various ways. For example, in FIG. 1 the offensive target for 1 yard pass could be made larger than that for 5 yard run while making the defensive target against the 10 yard pass much bigger than shown, as a variation. This embodiment would represent a fact that a pass may be easier but defense against it is also easier when compared to running game.

Figure 2:
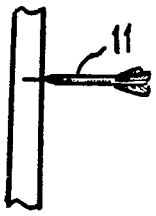
FIG. 2 shows a sectional side view of a target piece and a dart with a sharply-pointed end.
Figure 3:
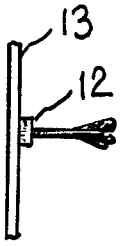
FIG. 3 shows in a schematic fashion a dart releaseably adhering to a target through the static magnetism.
Figure 4:
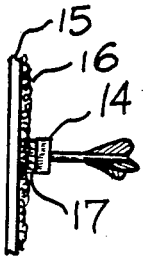
FIG. 4 shows in a schematic fashion a dart releaseably adhering to a target through the Velcro-action between loop and hook textile materials.

FIGS. 2 to 4 illustrate schematically various mechanisms of dart action as known to the world. FIG. 2 shows a sectional side view in which a dart 11 with a sharp point is shown to have penetrated into the target material. FIG. 3 shows schematically the magnetic dart action. FIG. 4 shows the Velcro-action dart 14 in which gripping force between the loop 16 and the hook 17 textures is holding the dart 14 onto the target 15.

Figure 5:
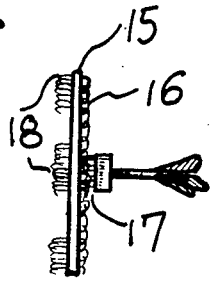
FIG. 5 shows the same shown in FIG. 4 but with a modification in that the backside of the target is also covered by a Velcro-action textile material so that as will be shown in FIG. 6 the target may be releasably attached to a board through the Velcro-action.
Figure 6:
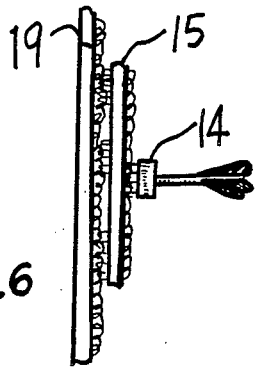
FIG. 6 shows schematically the target piece shown in FIG. 5 releaseably attached to a game board which is covered by a Velcro-action textile that matches with the textile material covering the backside of the target piece.

The back side of the target pieces may also have a means of releaseably holding the targets onto a game board. For example, the target piece 15 of FIG. 4 is redrawn in FIG. 5 but in a modified form in which the back side is covered with one type of Velcro-action textile (the hook in this example). FIG. 6 illustrates how the target piece of FIG. 5 may be releasably adhering to a game board 19, which is covered by the other type of Velcro-action textile (the loop in this example). In this way, the target pieces may be rearranged in any desired fashion on the board during the game.

Figure 7:
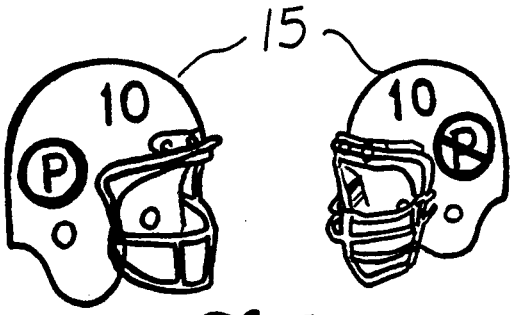
FIG. 7 shows schematically target pieces that take the shapes of the football helmet.

The target pieces may have shapes and styles that signify the feature of the real football. For example, the target pieces may have the shape of the football helmet, as shown in FIG. 7, of varying colors and designs. In FIG. 7 the numbers represent the yardage, the letters play options between "run" and "pass"; in FIG. 7, the capital letter "P" represents "Pass" option (and "R" "Running" option) in moving the ball. The line or bar across the letter "P" symbolizes "Block". Thus, the target on the left represents "10 yard pass attempt" and is to be used by the offensive team, while the target on the right represents its countermeasure, namely "10 yard pass attempt BLOCK" and is to be used by the defensive team.

Figure 8:
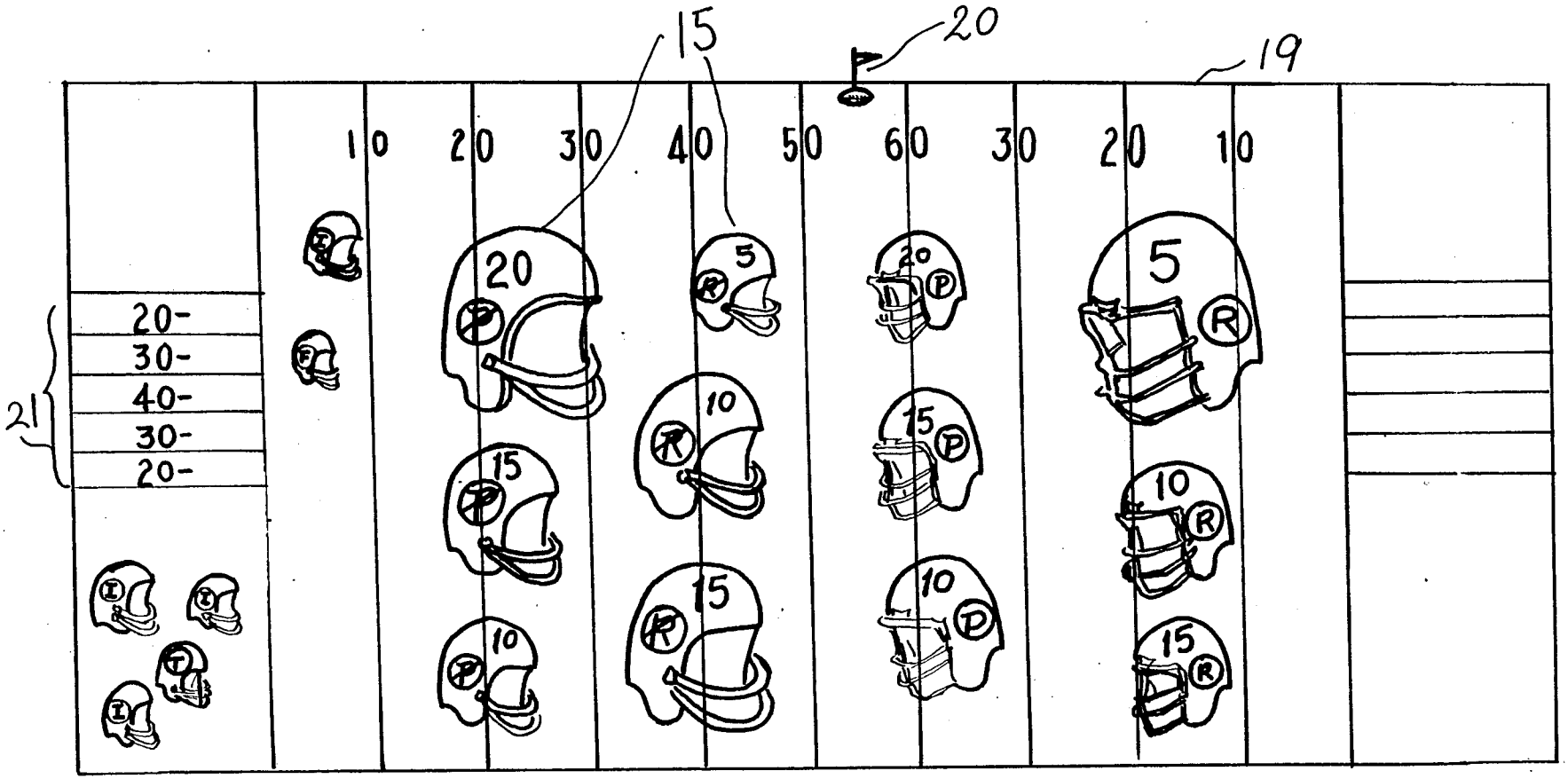
FIG. 8 shows a game board on which two groups of target pieces are arranged. The game board has a look of the football field with the lines and yardages on it. At the end zones are drawn dart target ranges that are being used for simulating the field goal kick.

FIG. 8 shows one of preferred embodiments of the present invention. A board 19 representing the football field is prepared on which are drawn all the lines and numbers that typifies the real football field, as shown. Target pieces 15 having the shape of the football helmet are placed on the game board 19. The targets are grouped into the two, namely, the offensive targets and the defensive targets. The groups may be made differentiable by different color coding, symbols, or other design features embedded on the target pieces. A yardage marker 20, preferably in a shape resembling the real football, is prepared to indicate the current position of the ball throughout the game. The first down is achieved by following the procedures and rules explained thoroughly above.

The target pieces 15 may have seperate physical bodies detached from each other. In this case, the target pieces may be placed on the game board 19 permanently, for example, by a glue; or may be releaseably attached to the game board by the magnetic or the Velcro-action mechanisms, as in FIG. 6 which shows schematically how the targets may be releasably attached to the game board by the Velcro-action. In the latter case the targets 15 may be rearranged on the game board 19 as players like.

For the sake of simplicity and low manufacturing cost, the target pieces 15 may be printed on the game board 19 as integral parts of the board: even in this case the targets 15 can still be termed as seperate "pieces" so long as the dart throwing actions are concerned.

All the basic game features and accompanying advantages of the present invention apply regardless of the physical nature of the target bodies and the game board.

Of course the game needs additional rules for punting, field goal kick, and sidekick. For the field goal kick, one possible embodiment is to prepare two dart target ranges 21 at the end zones as shown in FIG. 8. In the example, the ranges are from 40 yards to less than 20 yards. For example, when the offensive team has decided to try a field goal kick at the 30 yard range, he throws the dart with an aim of hitting the range inside the 30 yard mark: if the dart lands within the range, the goal kick attempt is considered to have been successful.

The punt return may be done in the following way as an example: the maximum punt return is understood to be 50 yards. Then let's assume that the ball is at the 40-yard line on the offensive field ground. Thus, in this example, the best achievable from the punt is to have the ball at the 10-yard line on the defensive field ground. Thus the offensive team throws the dart to have it landed as close as possible to the 10-yard line of the game board (FIG. 8). However, if the dart has landed inside the 10 yard line, the punt is set at a predetermined flat number, for example, a 25 yard punt, and the ball is put accordingly, that is at the 35 yard line of the defensive field ground in this example.

It is preferable to set a definite time limit for the duration of the game as in the real football game, such as 10 or 20 minutes total game time. One may or may not divide the game time into quarters and halves.

Surely one would benifit from good dart throwing skill in the game described above. However, game plans and tactics will be as important, if not more, in the game. Opprtunistic people may prefer the "20 yard pass attempt" to the "5 yard run attempt" in the offensive plays. However, the player knows that it will be easier for the defensive team to block it because the corresponding defensive target "20 yard pass block" is substantially bigger in size compared to the defensive target for "5 yard run attempt block". Thus, the offensive player may decide to be patient and aim for just "5 yard run attempt" in a particular offensive play. When losing heavily with little time left, defensive player may keep trying the hardest-to-hit targets such as "Fumble" and "Interception". In short, players of the game will experience all the excitement, need for self-refrain, decision moments for big gamble plays when losing heavily, time to play conservatively and steadily when leading substantially with only a short time left, etc.; that is, whatever the real football players and coaches are going through in playing and directing the real foodball games.

Figure 9:
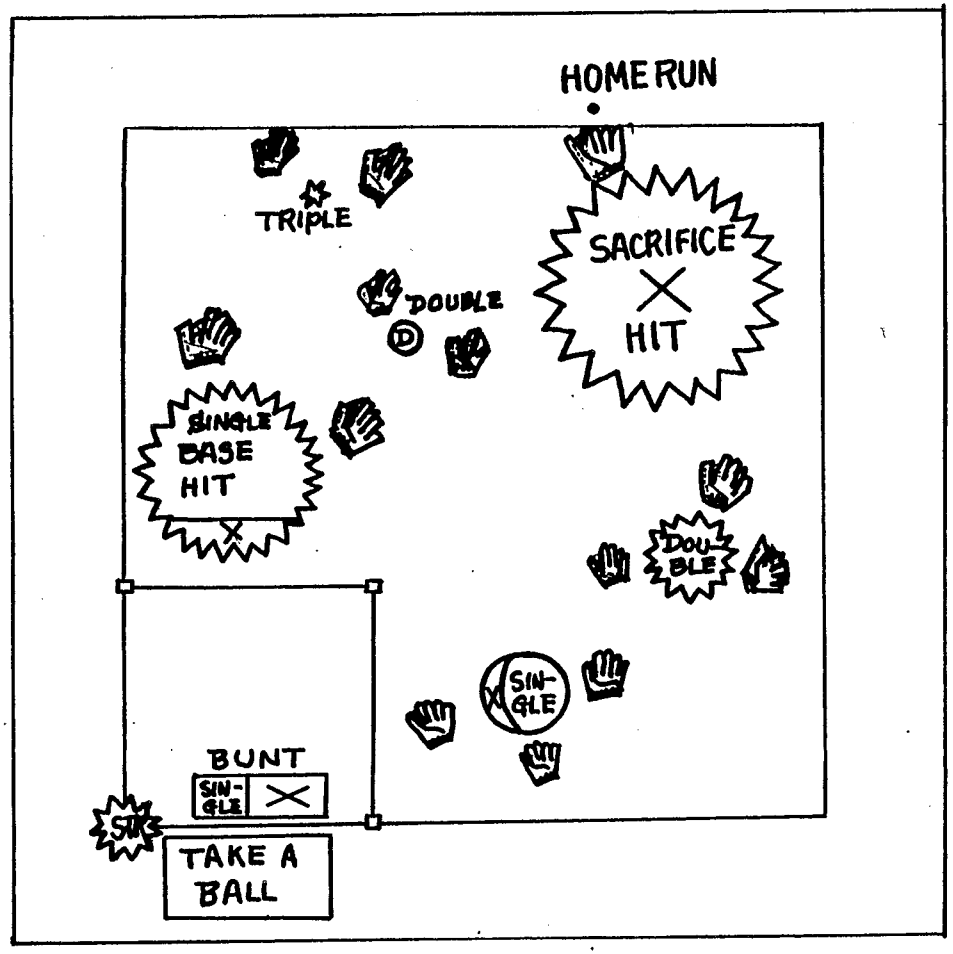
FIG. 9 schematically illustrates the present invention embodied into the baseball game.

It is obvious that various different designs and features may be conceived following the teachings of the present invention. As another example of embodiments of the present invention, FIG. 9 shows a simulated baseball game. The defensive team has only one target piece in this particular example: the piece target representing "the strike zone" in the ball pitching. If the defensive team fails in its turn to hit the "strike" target, it is intepreted as "a ball" pitching. Then the offensive team has a group of offensive targets some of which are to be used on "Strike" pitching and the rest on "Ball" pitching: In FIG. 9, when the pitching was "Strike", the offensive (batting) team can try only the offensive targets with the shape resembling the "Strike" target, namely the targets with zigzag contour lines as shown in FIG. 9 as an example, and when the pitching was a ball, the offensive team can try only the targets with round countour lines. The offensive targets in the case of the "Strike" pitching include "Single base hit", "Double base hit", "Triple base hit", "Home-run hit", and "Sacrifice flyball hit" in the particular example. If the pitching by the defensive team was a ball, the offensive targets that can be tried are limited to the targets with the round contour line in FIG. 9, namely "Single base hit", "Bunt", "Double base hit", "Take the ball (and don't swing the bat)".

Note that the basic fetures of the present invention applies here in which the dart throwings by the two teams are interrelated and interacting. The strike pitch gives the offensive team better chance for hit and run, while the ball pitch gives lesser chance. The dart game really simulates the real baseball in the present invention.

FIG. 9 also shows a plurality of ball-catching gloves scattered around the offensive target pieces laid in the field. If the dart lands on any of the gloves, the batting is considerd to have resulted an "Out". In a different embodiment the gloves may be considered as the defensive targets: in this case, the defensive team will be given a chance to hit the gloves with the dart after the offensive play: if the defensive attempt is a success, the previous batting results in an "Out" even if the offensive team succeeded in the previous turn in hitting one of the offensive targets.

To make the game more realistic, the targets for "Single base hit" have a part of the target areas classified as "X", which means that the hitter is tagged and out but "players" on the bases, if there have been, have advanced by one base.

As shown above, dart games embodied following the basic teachings of the present invention provide continuous interactions and responses between players, making the games intense and stimulating. This is especially so when the teachings are incorporated into the well-known games that have complex rules and require tactical decisions in running the games. In the conventional dart games the main activity and objective is simply getting high scores. Thus the mind is not really busy and excited. The dart throwing skill is about all that takes and matters. However, in the present invention the dart throwing becomes only a necessary part of very complex and tactical game features.

Even though the dart throwing skill remains an important factor, the whole games become almost infinitely complex and involved in the present invention. If we are to use an analogy, the conventional dart games may be compared to football throwing routines between two or three people standing in relatively fixed positions in a picnic area, while the present invention embodied into the football game can be compared to the real football game played in the real football field.

It is obvious that the teachings of the present invention may be embodied into various ways in varying forms. Accordingly, although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. Apparatus for playing a football dart game comprising:

a game board for receiving darts, said game board being designed to be recognizable as a simulated football field with the lines and yardage markers that typify the football field;

a plurality of offensive targets arranged on said game board, each offensive target containing identifications representing at least one of various play options available to be used by an offensive team in a football game; and a plurality of defensive targets arranged on said game board, each defensive target containing identifications representing at least one of various defensive play options available as the corresponding defensive countermeasures against the offensive play options of said offensive targets, and to be used by a defensive team;

each of said offensive and defensive targets being an individually distinct target and with a corresponding defensive target marked to counteract an offensive play option being provided for each offensive target marked to indicate an offensive play option in the game of football;

wherein said offensive targets are positioned on one side of the 50 yard line of said football field and said defensive targets are positioned on the other side of said 50 yard line;

so that two players or groups of players may play said football dart game in an interactive sequence of alternate dart throws by the two players or groups of players representing the offensive and defensive teams respectively.

2. Apparatus according to claim 1, wherein the identifications on said offensive targets represent various play options of the football game including ball carrying and ball passing, and the identifications on said defensive targets represent the corresponding defensive countermeasures of the football game including blocking of the ball carrying and ball passing.

3. Apparatus according to claim 1, wherein the mechanism to releasably hold said dart onto said targets upon physical contact is a Velcro-action.

4. Apparatus according to claim 1, wherein the outcome of the throwing of the darts for an offensive play is determined only after a throw of the darts by each of the two players or groups of players representing the offensive and defensive teams.

5. Apparatus according to claim 1, wherein said targets are designed in the shape of a football helmet.

6. Apparatus according to claim 1, wherein a target range showing various possible field goal kick ranges is provided on said game board.

7. Apparatus for playing a football dart game comprising:

a game board for receiving darts, said game board being designed to be recognizable as a simulated football field with the lines and yardage markers that typify the football field;

a plurality of offensive targets arranged on said game board, each offensive target containing identifications representing at least one of various play options available to be used by an offensive team in a football game; and a plurality of defensive targets arranged on said game board, each defensive target containing identifications representing at least one of various defensive play options available as the corresponding defensive countermeasures against the offensive play options of said offensive targets, and to be used by a defensive team;

the size of said offensive and defensive targets being inversely arranged according to the difficulty of completing the play considering the amount of yardage to be gained, so that for each offensive target marked to indicate an amount of yardage to be gained by an offensive play option in the game of football, there is a corresponding defensive target marked to indicate the blocking or thwarting of an attempt to gain the same amount of yardage, with the offensive targets being of decreasing size in target area as the amount of yardage to be gained by hitting said offensive target increases, and with the corresponding defensive targets being of increasing size in target area as the amount of potential offensive yardage or thwarted by hitting said defensive target increases;

wherein said offensive targets are positioned on one side of the 50 yard line of said football field and said defensive targets are positioned on the other side of said 50 yard line.

8. Apparatus according to claim 7, wherein the identifications on said offensive targets represent various play options of the football game including ball carrying and ball passing, and the identifications on said defensive targets represent the corresponding defensive countermeasures of the football game including blocking of the ball carrying and ball passing.

9. Apparatus according to claim 7, wherein the mechanism to releasably hold said dart onto said targets upon physical contact is a Velcro-action.

10. Apparatus according to claim 7, wherein the outcome of the throwing of the darts for an offensive play is determined only after a throw of the darts by each of the two players or groups of players representing the offensive and defensive teams.

11. Apparatus according to claim 7, wherein said targets are designed in the shape of a football helmet.

12. Apparatus according to claim 7, wherein a target range showing various possible field goal kick ranges is provided on said game board.

13. Apparatus for playing a football dart game comprising:

a game board for receiving darts, said game board being designed to be recognizable as a simulated football field with the lines and yardage markers that typify the football field;

a plurality of offensive targets arranged on said game board, each offensive target containing identifications representing at least one of various play options available to be used by an offensive team in a football game; and a plurality of defensive targets arranged on said game board, each defensive target containing identifications representing at least one of various defensive play options available as the corresponding defensive countermeasures against the offensive play options of said offensive targets, and to be used by a defensive team;

each of said offensive and defensive targets being a separate physical entity detached from the remaining targets, being of generally planar shape in a plane parallel to said game board, said targets being releasably attached to said game board and slidably movable thereon to vary the location and number of said targets on said game board;

wherein said offensive targets are positioned on one side of the 50 yard line of said football field and said defensive targets are positioned on the other side of said 50 yard line.

14. Apparatus according to claim 13, wherein the identifications on said offensive targets represent various play options of the football game including ball carrying and ball passing, and the identifications on said defensive targets represent the corresponding defensive countermeasures of the football game including blocking of the ball carrying and ball passing.

15. Apparatus according to claim 13, wherein the mechanism to releasably hold said dart onto said targets upon physical contact is a Velcro-action.

16. Apparatus according to claim 13, wherein the outcome of the throwing of the darts for an offensive play is determined only after a throw of the darts by each of the two players or groups of players representing the offensive and defensive teams.

17. Apparatus according to claim 13, wherein said targets are designed in the shape of a football helmet.

* * * * *